US006219925B1

(12) United States Patent
Chen

(10) Patent No.: US 6,219,925 B1
(45) Date of Patent: Apr. 24, 2001

(54) PUNCH HAVING CHANGEABLE PUNCHING MEMBER

(76) Inventor: Cheng Nan Chen, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 09/392,540

(22) Filed: Sep. 9, 1999

(51) Int. Cl.[7] ..... B26F 1/38

(52) U.S. Cl. ..... 30/358; 83/684

(58) Field of Search ..... 30/358, 363, 364, 30/366, 368; 83/684, 685

(56) References Cited

U.S. PATENT DOCUMENTS 3,108,558 * 10/1963 Galvin ..... 30/358 X

* cited by examiner

*Primary Examiner*—Douglas D. Watts

(57) ABSTRACT

A punch includes a mold piece disposed on a plate, and a barrel secured on the plate with an arm. A shaft is slidably received in the barrel and includes a punch rod secured to the bottom end. A lever has one end pivotally coupled to the barrel and has a middle portion secured to the shaft for moving the shaft and thus the punch rod downward to actuate on the mold piece. A housing includes a hub having one or more guide rails extended inward of the hub to engage with the punch rod and to guide the punch rod to move relative to the housing.

11 Claims, 5 Drawing Sheets

PUNCH HAVING CHANGEABLE PUNCHING MEMBER

BACKGROUND OF THE INVENTION

1. Field of the Invention

The present invention relates to a punch, and more particularly to a punch having one or more punching members that may be replaced with each other.

2. Description of the Prior Art

Typical punches comprise a punch rod slidably received in a housing, a knob secured on top of the punch rod for forcing the punch rod downward to cut or to punch the sheet members. A spring is engaged with the punch rod for biasing the punch rod away from the sheet members before the punch rod is depressed against the sheet members. The punch rod has a predetermined shape which may be used to punch or to form a predetermine-shaped pattern on the sheet members. The patterns may not be changed.

The present invention has arisen to mitigate and/or obviate the afore-described disadvantages of the conventional punches.

SUMMARY OF THE INVENTION

The primary objective of the present invention is to provide a punch including one or more punching members that may be replaced and changed with each other according to the user's need.

In accordance with one aspect of the invention, there is provided a punch comprising a plate, a mold piece disposed on the plate and including a cavity formed therein, an arm including a first end having a barrel secured thereon, and including a second end secured to the plate, a shaft slidably received in the barrel and including a bottom end extended downward and outward of the barrel, a punch rod secured to the bottom end of the shaft and moved in concert with the shaft, means for moving the shaft and the punch rod downward to actuate on the mold piece.

The shaft includes a middle portion, the moving means includes a lever having a first end pivotally secured to the barrel at a pivot axle and having a middle portion, and a pin engaged through the middle portions of the lever and of the shaft for allowing the lever to move the shaft and the punch rod to actuate on the mold piece. The barrel includes an oblong hole formed therein for slidably receiving the pin and for allowing the pin to be moved up and down relative to the barrel. A spring biasing device is further provided for biasing the shaft and the punch rod away from the mold piece.

A securing device is further provided for securing the punch rod to the shaft and includes a catch secured to the shaft and having one or more ribs detachably engaged into one or more engaging channels of the punch rod for detachably securing the punch rod to the shaft. A gasket is further engaged between the punch rod and the catch for securing the punch rod to the catch.

A device is further provided for aligning the punch rod with the mold piece and includes a housing having a bottom portion, a board secured to the bottom portion of the housing and having a hub provided thereon for slidably receiving the punch rod, and means for guiding the punch rod to move relative to the housing and the board. The guiding means includes at least one guide rail formed on the hub of the board, and at least one slot formed in the punch rod for slidably receiving the guide rail and for guiding the punch rod to move relative to the housing and the board and for preventing the punch rod from being rotated relative to the housing and the board.

The housing includes at least one depression formed therein, the board includes at least one projection extended therefrom and engaged into the depression of the housing for further securing the board to the housing. A panel includes a hole formed therein for receiving the mold piece, and means for detachably securing the panel to the plate. The plate includes a retaining member secured thereon, the panel includes a peripheral flange extended laterally outward therefrom for engaging with the retaining member and for detachably securing the panel to the plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
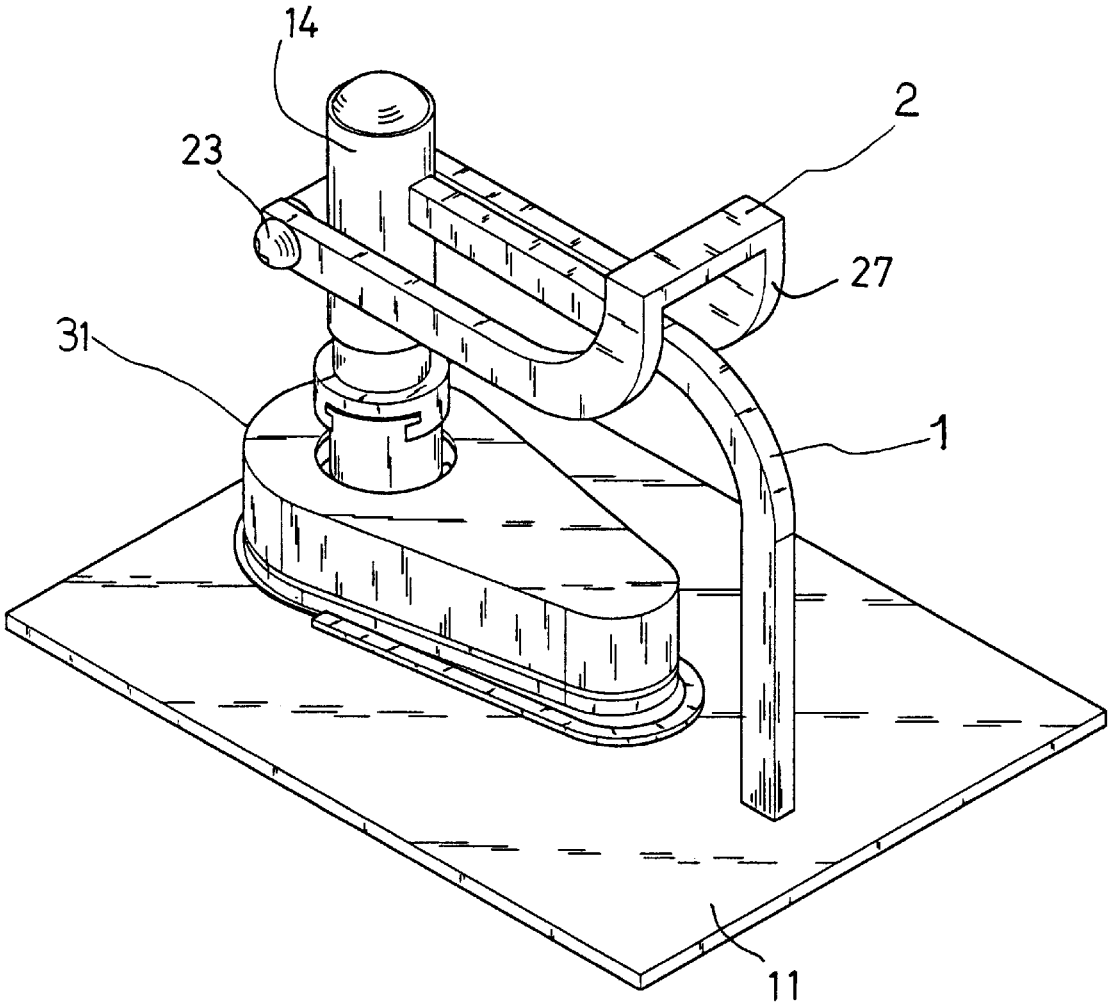
FIG. 1 is a perspective view of a punch in accordance with the present invention.
Figure 2:
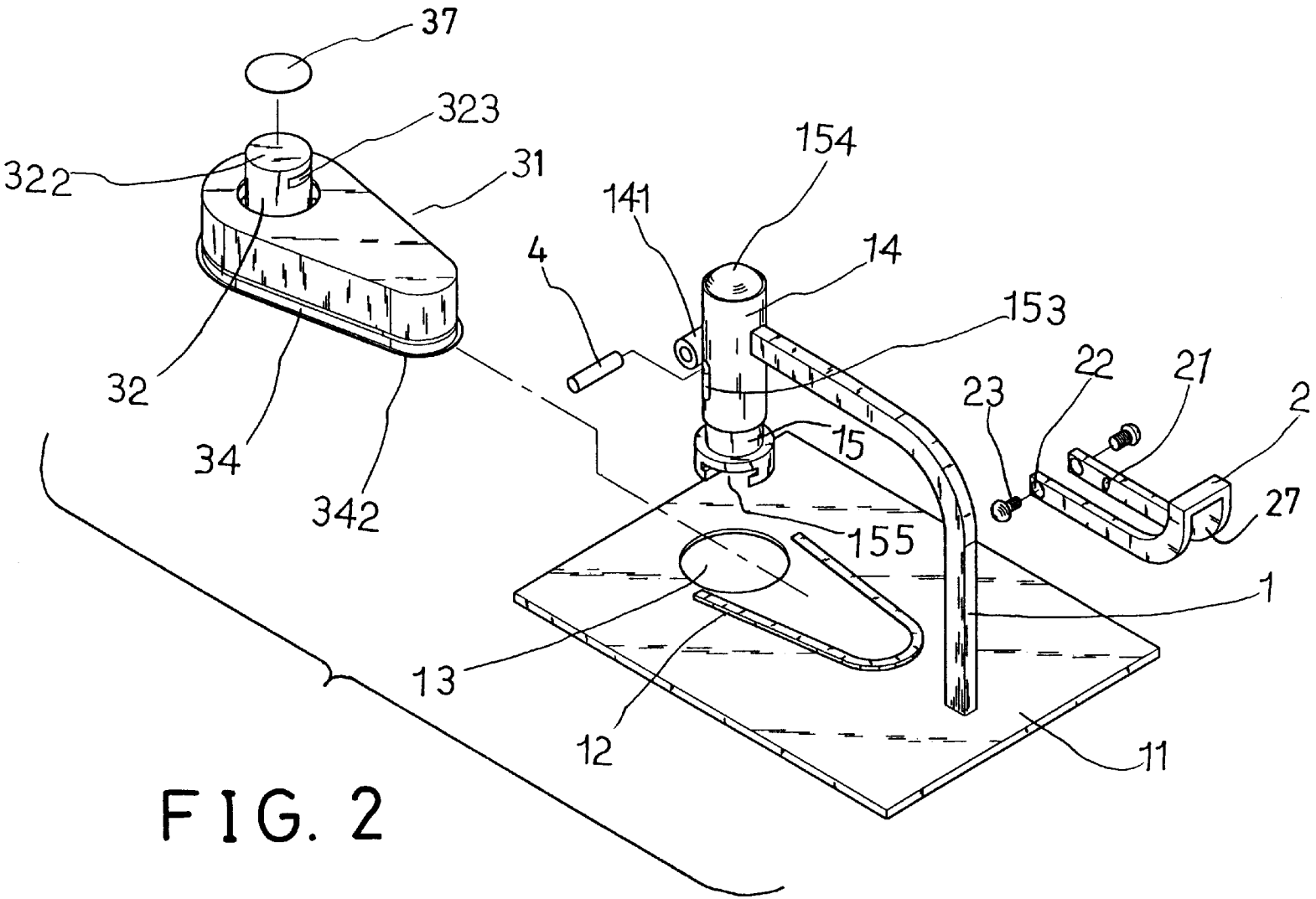
FIG. 2 is a partial exploded view of the punch.
Figure 3:
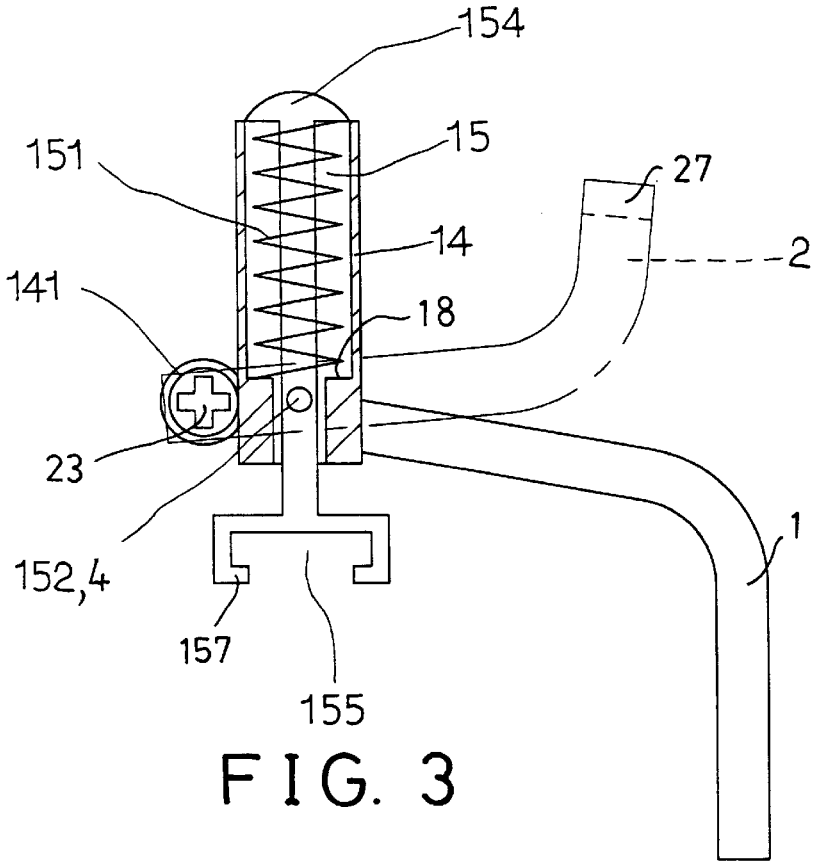
FIG. 3 is a partial cross sectional view of the punch.

Referring to the drawings, and initially to FIGS. 1–3, a punch in accordance with the present invention comprises an arm 1 secured on a plate 11 which includes an opening 13 formed therein for allowing the punched material to be moved out of the plate 11 and which includes a substantially V-shaped retaining member 12 provided thereon and having an open end facing toward the opening 13 of the plate 11. It is preferable that the arm 1 includes a bent portion formed in the middle portion thereof. A barrel 14 is secured to the upper end of the arm 1 for receiving a shaft 15 and a spring 151 therein and includes a peripheral shoulder 18 formed therein for engaging with the spring 151 and for retaining the spring 151 in the barrel 14. The shaft 15 includes a head 154 provided on top thereof and engaged with the spring 151 such that the spring 151 may bias the shaft 15 upward relative to the barrel 14 or may bias the shaft 15 upward away from the plate 11. The shaft 15 includes a catch 155 provided on the bottom thereof and extended downward and outward of the barrel 14 and having a pair of ribs 157 extended inward therefrom. The barrel 14 includes one or a pair of oblong holes 153 (FIG. 1) formed therein for slidably receiving a pin 4 which is engaged through a middle hole 152 of the shaft 15 (FIGS. 3, 5, 6), such that the pin 4 moves up and down in concert with the shaft 15.

A lever 2 includes one end 22 pivotally secured to the hub 141 of the barrel 14 at a pivot axle 23 that is formed by the fasteners 23 and includes one or more holes 21 formed in the middle portion thereof for receiving the end portions of the pin 4 such that the lever 2 may move the shaft 15 downward against the spring 151. The lever 2 includes a handle 27 formed on the other end opposite to the pivot axle 23. The distance between the handle 27 and the pin 4 is greater than that between the pin 4 and the pivot axle 23, such that the moving distance or the moving stroke of the pin 4 is limited, and such that the handle 27 may apply a great torque to the shaft 15 via the pin 4.

Figure 6:
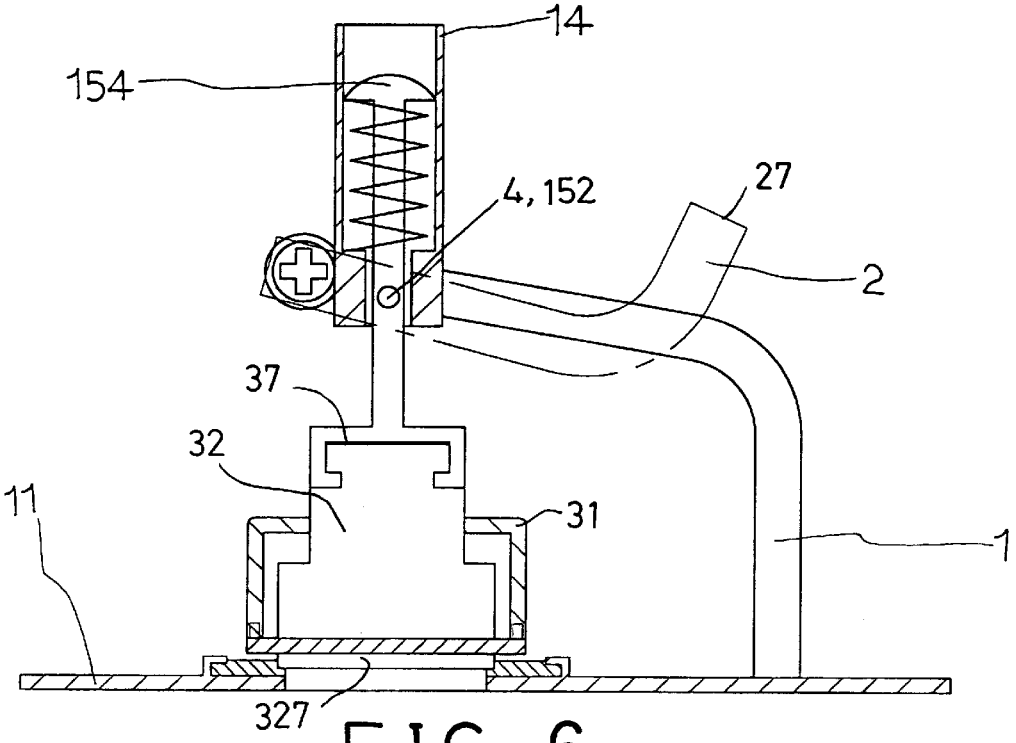
FIG. 6 is a cross sectional view illustrating the operation of the punch.
Figure 4:
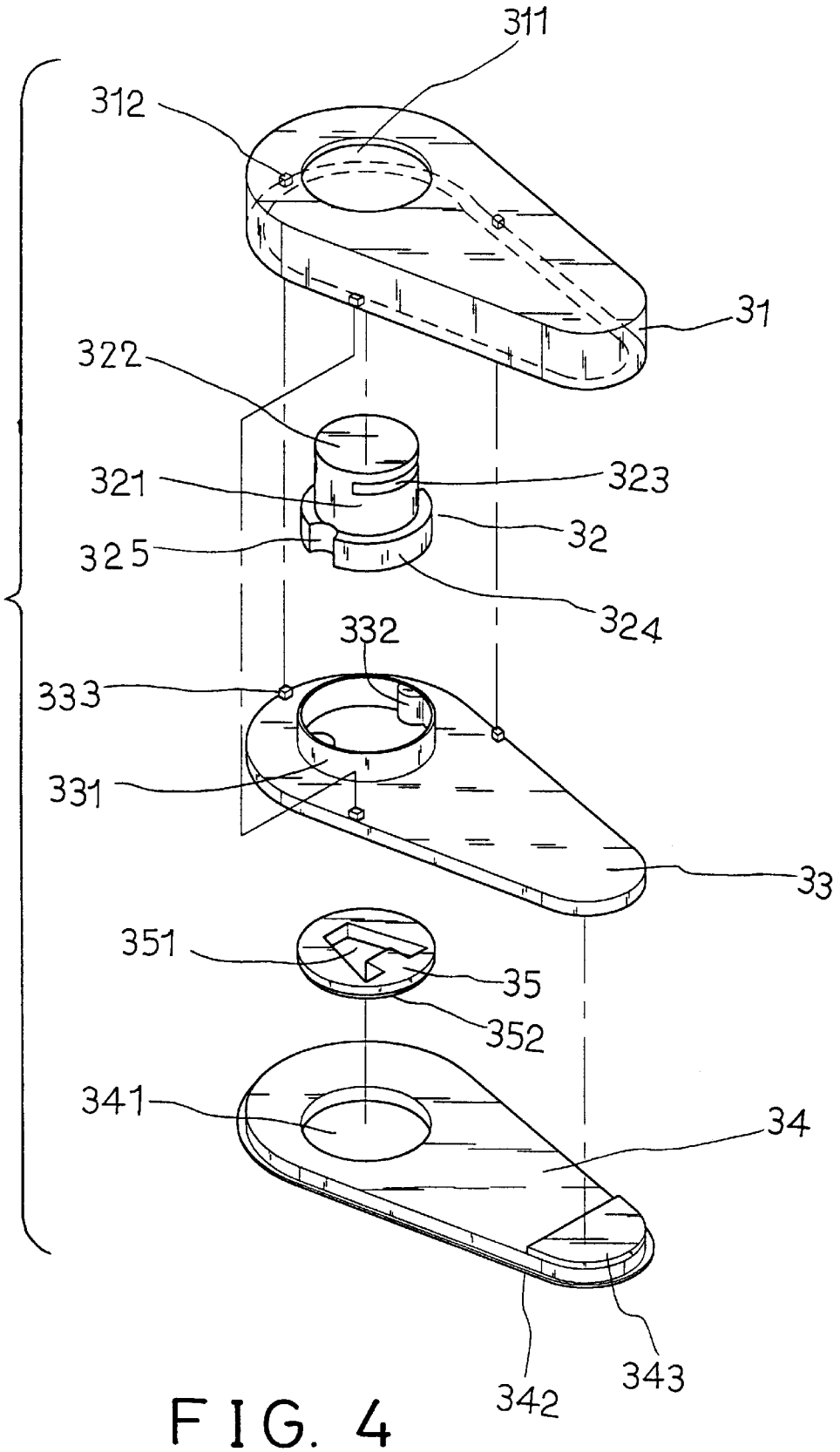
FIG. 4 is a partial exploded view of the punch.
Figure 5:
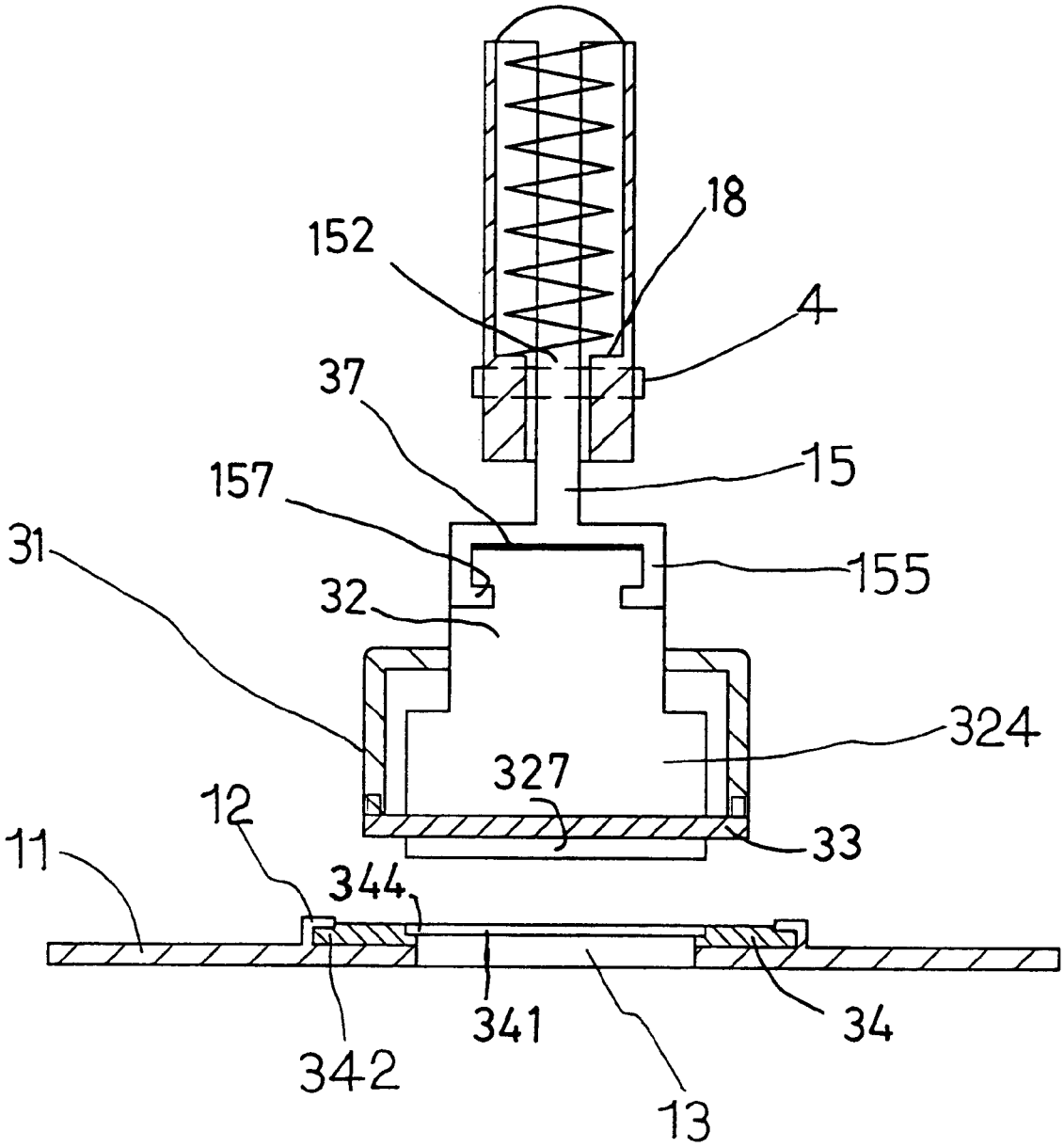
FIG. 5 is a partial cross sectional view of the a punch.

Referring next to FIGS. 4–6, and again to FIGS. 1 and 2, the punch includes a housing 31 having an orifice 311 formed in the upper portion thereof and having one or more depressions 312 formed in the bottom portion thereof. A board 33 is secured to the bottom of the housing 31 by such as the adhesive materials or by welding processes, and includes one or more projections 333 engaged into the depressions 312 of the housing 31, and includes a hub 331 extended upward therefrom and extended inward of the housing 31, and includes one or more guide rails 332 extended inward of the hub 331. A punch rod 32 includes a pole 321 extended upward from the base 324 thereof and slidably engaged through the orifice 311 of the housing 31, and includes one or more engaging channels 323 formed therein for slidably receiving the ribs 157 of the catch 155 and for detachably securing the punch rod 32 to the shaft 15 by such as a force-fitting engagement. A gasket 37 or the like is secured on the upper surface 322 of the punch rod 32 and is engaged with the catch 155 (FIGS. 5, 6) for increasing the frictional force between the punch rod 32 and the catch 155 and for further detachably securing the punch rod 32 to the shaft 15 by the force-fitted engagement. The base 324 of the punch rod 32 includes one or more slots 325 formed therein for slidably receiving the guide rails 332 of the board 33 and for guiding the punch rod 32 to move up and down relative to the hub 331 of the board 33 and for preventing the punch rod 32 from rotating relative to the board 33.

A panel 34 includes a peripheral flange 342 laterally extended outward therefrom for engaging with the retaining member 12 and for being secured to the plate 11. The panel 34 includes a hole 341 aligned with the hub 331 of the board 33 and with the punch rod 32. A mold piece 35 includes a peripheral shoulder 352 formed therein for engaging with the corresponding peripheral shoulder 344 of the panel 34 (FIG. 5) and for securing the mold piece 35 in the panel 34. The mold piece 35 may be secured to the panel 34 with a detachable and force-fitted engagement or by an adhesive material or by a welding process. The mold piece 35 includes a cavity 351 formed therein and having a shape corresponding to the pattern or the letter or the word to be punched and formed. The punch rod 32 includes a mold element 327 (FIGS. 5, 6) extended downward therefrom and having a shape corresponding to that of the pattern cavity 351 of the mold piece 35 for engaging into the pattern cavity 351 of the mold piece 35 and for punching the pattern on the sheet members that are engaged on the panel 34. The panel 34 preferably includes a spacer 343 provided thereon and extended upward from one end thereof for engaging with the board 33 and for determining the greatest size of the sheet members to be punched, for example.

It is to be noted that the housing 31 and/or the panel 34 and/or the retaining member 12 preferably include a non-circular or a non-symmetric shape, such that the direction of the pattern cavity 351 of the mold piece 35 and/or of the mold element 327 of the punch rod 32 may be determined and aligned. It is further to be noted that, alternatively, the punch rod 32 may also be directly secured to the catch 155 of the shaft 15 without the housing 31 and the board 33. The mold piece 35 may also be directly secured or disposed on the plate 11 without the panel 34.

In operation, as shown in FIGS. 5 and 6, the shaft 15 and thus the punch rod 32 may be moved downward toward and to engage with the mold piece 35 by depressing the handle 27 of the lever 2 against the spring 151. The lever 2 may apply a great torque against the punch rod 32 such that the punch rod 32 may be actuated to cut the sheet members that have a greater thickness. The provision of the housing 31 and the panel 34 and the retaining member 12 is for aligning the mold piece 35 and the mold element 327 of the punch rod 32.

Accordingly, the punch in accordance with the present invention includes one or more punching members that may be replaced and changed with each other according to the user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punch comprising:

a plate, a mold piece disposed on said plate and including a cavity formed therein, an arm including a first end having a barrel secured thereon, and including a second end secured to said plate, said barrel including an oblong hole formed therein, a shaft slidably received in said barrel and including a bottom end extended downward and outward of said barrel, said shaft including a middle portion, a punch rod secured to said bottom end of said shaft and moved in concert with said shaft, means for moving said shaft and said punch rod downward to actuate on said mold piece, said moving means including a lever having a first end pivotally secured to said barrel at a pivot axle and having a middle portion, and a pin engaged through said middle portions of said lever and of said shaft for allowing said lever to move said shaft and said punch rod to actuate on said mold piece, said oblong hole of said barrel being provided for slidably receiving said pin and for allowing said pin to be moved up and down relative to said barrel.

2. The punch according to claim 1 further comprising means for biasing said shaft and said punch rod away from said mold piece.

3. The punch according to claim 1 further comprising means for securing said punch rod to said shaft.

4. A punch comprising:

a plate, a mold piece disposed on said plate and including a cavity formed therein, an arm including a first end having a barrel secured thereon, and including a second end secured to said plate, a shaft slidably received in said barrel and including a bottom end extended downward and outward of said barrel, a punch rod secured to said bottom end of said shaft and moved in concert with said shaft, said punch rod including at least one engaging channel formed therein, means for moving said shaft and said punch rod downward to actuate on said mold piece, and means for securing said punch rod to said shaft, said securing means including a catch secured to said shaft and having at least one rib extended therefrom and detachably engaged into said at least one engaging channel of said punch rod for detachably securing said punch rod to said shaft.

5. The punch according to claim 4 further comprising a gasket engaged between said punch rod and said catch for securing said punch rod to said catch.

6. The punch according to claim 1 further comprising means for aligning said punch rod with said mold piece.

7. A punch comprising:

a plate, a mold piece disposed on said plate and including a cavity formed therein, an arm including a first end having a barrel secured thereon, and including a second end secured to said plate, a shaft slidably received in said barrel and including a bottom end extended downward and outward of said barrel, a punch rod secured to said bottom end of said shaft and moved in concert with said shaft, means for moving said shaft and said punch rod downward to actuate on said mold piece, and means for aligning said punch rod with said mold piece, said aligning means including a housing having a bottom portion, a board secured to said bottom portion of said housing and having a hub provided thereon for slidably receiving said punch rod, and means for guiding said punch rod to move relative to said housing and said board.

8. The punch according to claim 7, wherein said guiding means includes at least one guide rail formed on said hub of said board, and at least one slot formed in said punch rod for slidably receiving said at least one guide rail and for guiding said punch rod to move relative to said housing and said board and for preventing said punch rod from being rotated relative to said housing and said board.

9. The punch according to claim 7, wherein said housing includes at least one depression formed therein, said board includes at least one projection extended therefrom and engaged into said at least one depression of said housing for further securing said board to said housing.

10. The punch according to claim 7 further comprising a panel including a hole formed therein for receiving said mold piece, and means for detachably securing said panel to said plate.

11. The punch according to claim 10, wherein said plate includes a retaining member secured thereon, said panel includes a peripheral flange extended laterally outward therefrom for engaging with said retaining member and for detachably securing said panel to said plate.

* * * * *